United States Patent [19]

Williams

[11] 3,968,661

[45] July 13, 1976

[54] JEWELRY HAVING ROTATABLE INDICIA-BEARING DISC AND INDICATING MEANS

[75] Inventor: Francis E. Williams, North Scituate, R.I.

[73] Assignee: Carl-Art, Inc., Providence, R.I.

[22] Filed: Sept. 23, 1974

[21] Appl. No.: 508,268

[52] U.S. Cl. ..... 63/31; 63/20

[51] Int. Cl.[2] ..... A44C 25/00

[58] Field of Search ..... 63/31, 20

[56] References Cited

UNITED STATES PATENTS

| | | | |
|---|---|---|---|
| 2,177,978 | 10/1939 | Darvie | 63/20 X |

FOREIGN PATENTS OR APPLICATIONS

| | | | |
|---|---|---|---|
| 1,242,237 | 8/1960 | France | 63/31 |
| 1,493,533 | 7/1967 | France | 63/32 |
| 263,280 | 12/1926 | United Kingdom | 63/31 |

*Primary Examiner*—E. Barry Shay

*Attorney, Agent, or Firm*—Salter & Michaelson

[57] ABSTRACT

An ornamental article for personal wear comprising a rotatable disc, the periphery of which is divided into a plurality of equal sections, each section having provided therein ornamentation having a horoscopic significance or the like, and fixed indicating means adapted to be aligned with any selected one of the sections, whereby the disc may be rotated until the desired section is aligned with the indicating means.

1 Claim, 5 Drawing Figures

JEWELRY HAVING ROTATABLE INDICIA-BEARING DISC AND INDICATING MEANS

BACKGROUND AND SUMMARY OF THE INVENTION

The present invention relates generally to an article of jewelry or the like, which may be in the form of a pendant adapted to be suspended from a neck chain or the like, although not limited to such use, since the instant invention could also be in the form of a brooch adapted to be pinned to one's apparel for wearing.

More specifically, the present invention relates to jewelry having a multiple significance, such as zodiac jewelry, birthstone jewelry, or the like. The problem with such jewelry, both from a manufacturing and retail standpoint, is an inventory problem; since where such jewelry is limited to a single representation, such as one zodiac sign, one birthstone or month, it will be obvious that such jewelry would have to be manufactured and inventoried in multiples of twelve, thus creating a serious problem.

It is therefore a primary object of the present invention to provide a single article of manufacture which contains multiple representations, the article being so constructed that any desired representation may readily and easily be moved to what may be considered as the viewing position on the device. In order to emphasize and accentuate the viewing position, indicating means are provided as a part of the device for focusing one's attention to the particular representation that has been moved to the viewing position.

Thus, in accordance with the present invention, a single article is provided which inherently has the capability of being adjustable for multiple representations, whereby instead of having to make and inventory a multiple number of articles, such as twelve articles where zodiac signs are involved, for example, only a single article need now be manufactured.

In order to accomplish this objective, a circular disc is rotatably mounted on a circular back plate, the mounting being such that the disc is free to rotate; but at the same time a frictional drag resists said rotation. The disc is divided into a plurality of equal peripheral sections, each of which is provided with a different form of ornamentation, such as with the different zodiac signs or the like. Fixed indicating means are provided on the article, said indicating means overlying the peripheral edge of the rotating disc and being substantially equal in width to the width of one of the sections in said disc. The disc may then be manually rotated until the desired section is in alignment with the indicating means, and then the article is worn with the selected section in the top or twelve-o'clock position.

Other objects, features and advantages of the invention will become apparent when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 4:
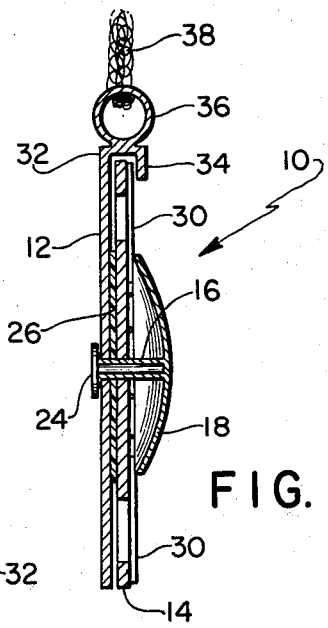
FIG. 4 is a section taken on line 4—4 of FIG. 1.
Figure 5:
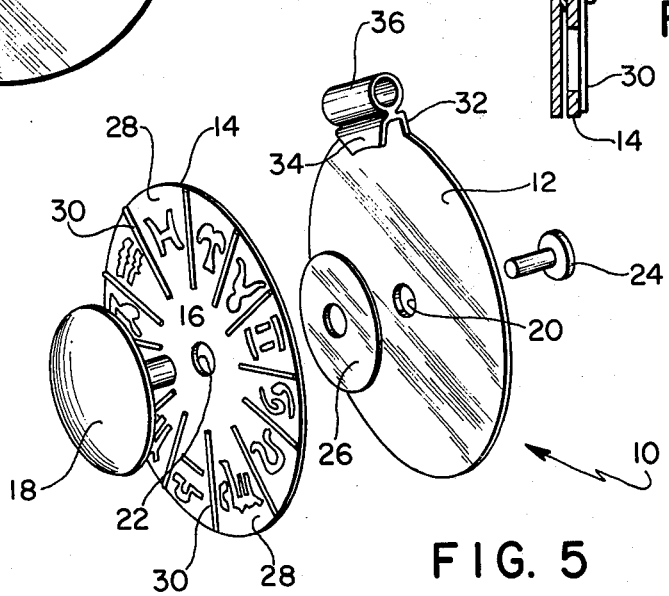
FIG. 5 is an exploded perspective view showing the components which make up the present invention.

Referring now to the drawings, an article of jewelry embodying the present invention is shown generally at 10, said article comprising a circular back plate 12 and a circular front disc 14 of generally the same diameter. Both the plate 12 and the disc 14 are preferably, although not necessarily, of metallic construction and are rotatably secured to each other by means of a hollow pin or rivet 16 having an enlarged domed head 18, the pin 16 extending through central openings 20, 22 in plate 12 and disc 14, respectively. A stud member 24 is then press-fit within pin 16 to complete the assembly, as illustrated most clearly in FIGS. 4 and 5.

In order to provide a smoother rotation between disc 14 and plate 12, a plastic washer 26, of nylon or the like, is sandwiched between said disc and plate so that some degree of frictional drag will oppose rotation of the disc 14. The washer 26 also functions to prevent rubbing or scratching of the plates as they rotate, particularly where the plates are of metallic construction.

The outer surface of disc 14 is divided into a plurality of equal peripheral sections 28, such as by providing integral, raised, radially extending ribs 30. Within each section 28 there is provided some form of ornamentation; and in the particular form of the invention illustrated, it will be noted that each section 28 has therein one of the twelve zodiac signs; and, specifically, the disc 14 has been blanked or pierced to provide said signs. It will be obvious, however, that the present invention is not limited to the presentation of zodiac signs, but rather any other multiple representation may be associated with disc 14. For example, the months of the year, birthstones, and even different initials could be provided in each section 28, it being obvious that the number of sections would then be determined by the number of multiples necessary to make a complete representation. Also, it is not necessary that the ornamentation be blanked into each section 28, but rather it could be engraved thereon, affixed thereto by soldering, etc.

Extending upwardly from back plate 12 is an integral, reversely bent indicator 32, said indicator extending forwardly and then terminating in a downwardly extending tongue portion 34 which overlies the outer peripheral edge of disc 14. As will be noted, tongue 34 is dimensioned and configured so as to align with any selected section 28, whereupon said tongue actually focuses the attention of a viewer on the selected section. Secured to the top of indicator 32, as by soldering or the like, is a tubular member 36 adapted to receive therethrough chain 38, whereby the article 10 may be worn as a pendant. As will be obvious, when so worn, indicator 32 and tongue 34 will automatically be at the top or twelve-o'clock position; whereupon the section 28 which has been aligned with the indicator will likewise be so positioned. It will be understood, however, that the article 10 is not limited to use as a pendant, but rather a conventional pin could be affixed to the rear of back plate 12 whereby the article could be worn as a brooch as long as care is taken that the article, when so worn, is positioned so that the indicator means are located at the top or twelve-o'clock position.

It will be understood that pin 16 and stud 24 effect a secure assembly between back plate 12 and disc 14, with washer 26 interposed therebetween. The peripheral edge of enlarged domed portion 18 engages the inner ends of ribs 30 and bears lightly thereagainst.

Figure 1:
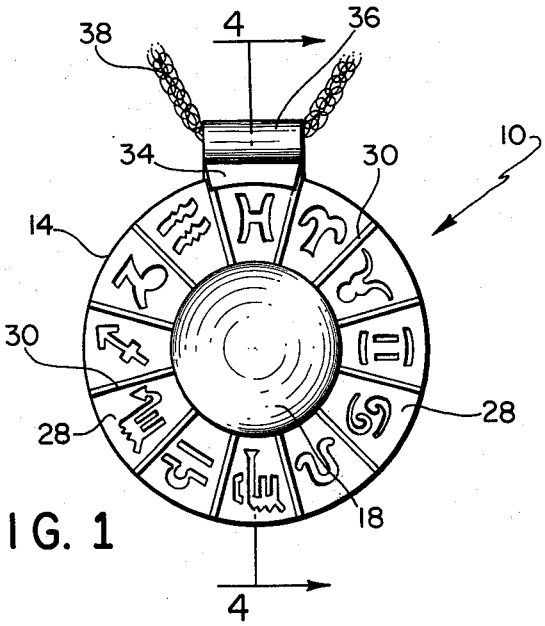
FIG. 1 is a front elevational view of an article of jewelry embodying the present invention.
Figure 2:
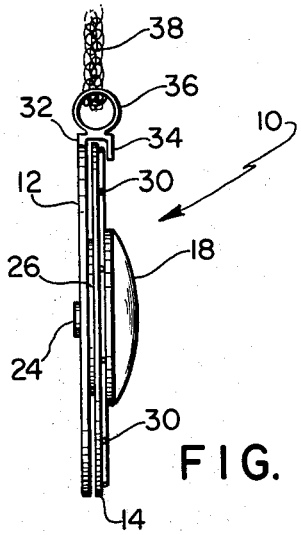
FIG. 2 is a side elevational view thereof.
Figure 3:
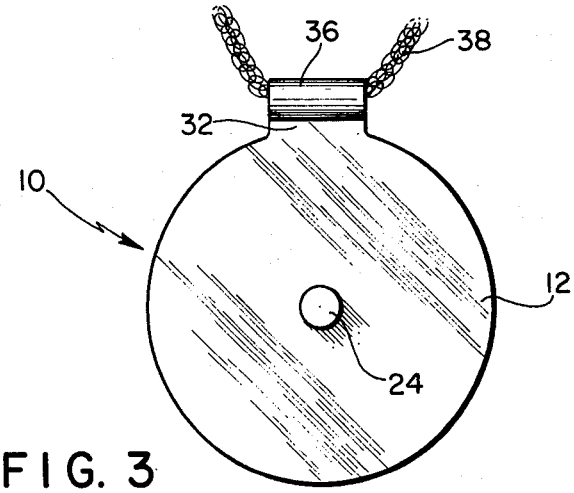
FIG. 3 is a rear elevational view thereof.

It will be understood that a purchaser of the article 10 simply manually rotates disc 14 until the section 28 having the pertinent representation therein is aligned with tongue 34 of indicator 32, as illustrated in FIG. 1. The device is then ready to be worn and, when suspended from a neck chain or the like, will automatically assume a position wherein both the indicator and the selected section are in the top or twelve-o'clock positon. Since the article 10 has the capability of being adjusted so as to emphasize and accentuate any one of the multiple representations contained in the sections 28, it follows that the manufacturing and inventory problems normally present where each article only contains a single representation are effectively eliminated. In addition, the article 10 has a minimum number of movable parts and hence is economically feasible to manufacture; while at the same time the article has an attractive appearance which is important where the article has a cosmetic significance.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ornamental article adapted to be worn on the person, comprising a flat, rigid, generally circular back plate, a generally circular front disc rotatably mounted on said back plate, means on the front surface of said disc defining a plurality of substantially equal sections located adjacent the outer periphery of said disc, each section having a different form of ornamentation provided therein, and indicating means fixedly carried by said back plate and having a portion located adjacent the periphery of said disc, said portion corresponding generally to the outer peripheral width of said sections, whereby said disc may be manually rotated until a desired section is in alignment with said indicating means, said indicating means comprising a reversely bent, integral extension of said back plate, and means fixedly secured to the top of said indicating means for receiving a neck chain or the like, whereby when said article is suspended during normal use, said indicating means will automatically be located at the top of said article, said receiving means comprising an elongated tube extending laterally across the top of said indicating means and substantially co-extensive therewith, the means for rotatably mounting said disc on said back plate comprising a pin extending centrally through said disc and plate, an enlarged head at the front of said pin overlying said disc and means at the back end of said pin securing said disc and plate together, and a plastic washer on said pin between said plate and disc, said washer causing a frictional drag to exist when said disc is rotated relative to said plate, said defining means comprising a plurality of integral, raised, radial ribs, and said enlarged head comprising a domed portion overlying the central portion of said disc, the peripheral edge of said domed portion engaging said ribs.

* * * * *